United States Patent [19]

Bell et al.

[11] 4,116,378

[45] Sep. 26, 1978

[54] CARTON WITH RECLOSABLE INSPECTION FLAP

[75] Inventors: Richard L. Bell, Glenmorre; Patricia A. Josephs, Wayne; Francis A. Chidsey, Jr., Devon, all of Pa.

[73] Assignee: Container Corporation of America, Chicago, Ill.

[21] Appl. No.: 844,808

[22] Filed: Oct. 25, 1977

[51] Int. Cl.[2] ..... B65D 65/12

[52] U.S. Cl. ..... 229/87 F; 206/45.31; 206/626; 426/121

[58] Field of Search ..... 229/87 F, 33; 206/45.31, 626; 426/121

[56] References Cited

U.S. PATENT DOCUMENTS

| | | | |
|---|---|---|---|
| 1,563,907 | 12/1925 | Koff | 229/33 V |
| 2,306,078 | 12/1942 | Nydegger | 206/45.31 |
| 2,878,985 | 3/1959 | Rossum | 229/87 F |
| 3,100,597 | 8/1963 | Saidel et al. | 229/87 F |
| 3,409,445 | 11/1968 | Hall | 229/87 F |
| 3;734,274 | 5/1973 | Körner | 229/87 F |
| 3,885,731 | 5/1975 | Mullinix | 426/121 |
| 3,960,315 | 6/1976 | Dobbins | 229/87 F |

*Primary Examiner*—Stephen P. Garbe
*Attorney, Agent, or Firm*—Carpenter & Ostis

[57] ABSTRACT

A folding carton having a partially detachable, reclosable panel section for viewing contents of the carton.

14 Claims, 8 Drawing Figures

CARTON WITH RECLOSABLE INSPECTION FLAP

BACKGROUND OF THE INVENTION

This invention relates to paperboard display cartons of the type used to package items such as bacon, and which have a partially detachable inspection flap or viewing panel which permits inspection of a portion of the contents of the package without destroying the overall integrity of the package.

This invention relates to an improvement in a display carton of the type disclosed in U.S. Pat. No. 3,960,315 wherein an inspection flap is provided to permit one to view the contents of the package which are not otherwise exposed, such as in a package for slices of bacon. The improvement resides in the provision of means for positively locking the inspection flap in a closed position after it has been initially opened.

It is, therefore, an object of the invention to provide in a carton of the type described, a partially detachable viewing panel section having positive interlocking means with other portions of the carton to maintain the viewing panel section in a closed position after it has been initially opened.

Another object of the invention is the provision, in a carton of the type described, of means for preventing the accidental tearing of a portion of the carton beyond the weakened lines which permit partial detachment of a portion of the carton.

These and other objects of the invention will be apparent from an examination of the following description and drawings.

THE DRAWINGS

Figure 1:
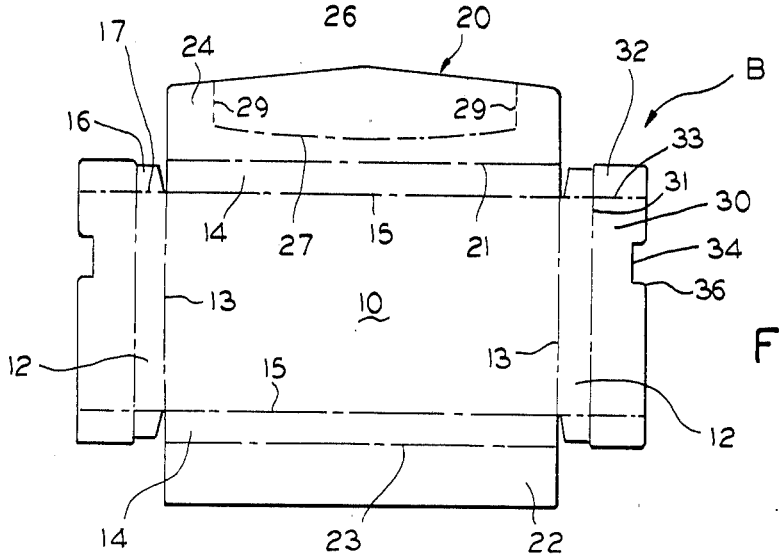
FIG. 1 is a plan view of the blank from which the carton embodying features of the invention illustrated in FIGS. 2 through 4 may be formed.
Figure 3:
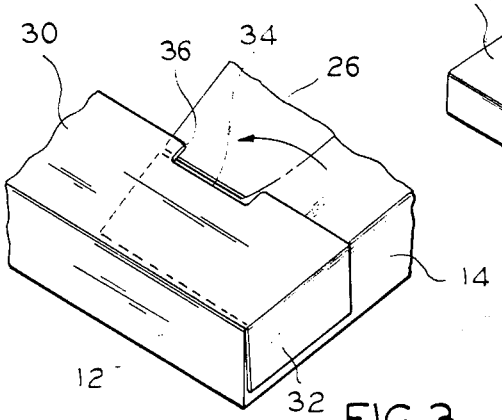
FIG. 3 is an enlarged view of a portion of the structure illustrated in FIG. 2.
Figure 5:
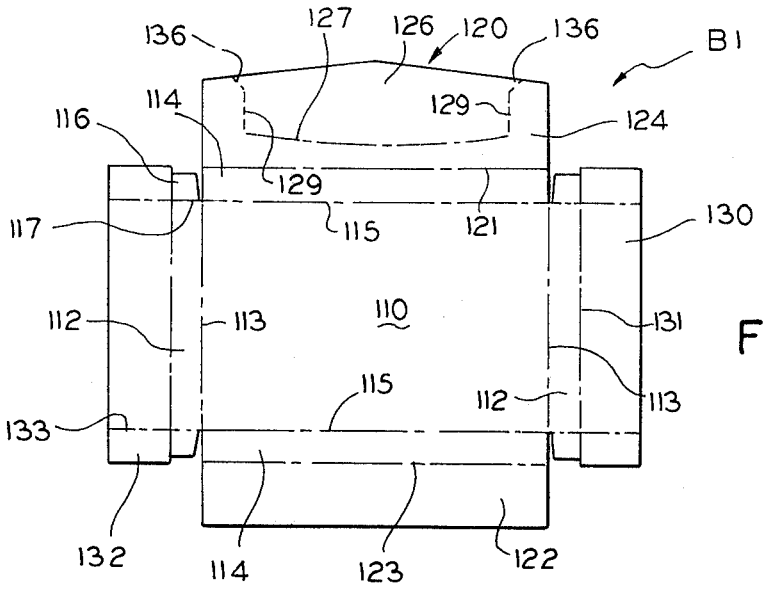
Figure 6:
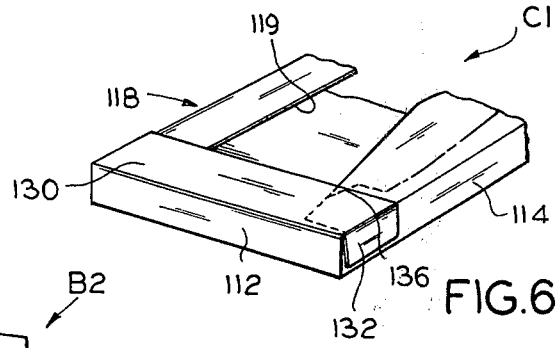
Figure 7:
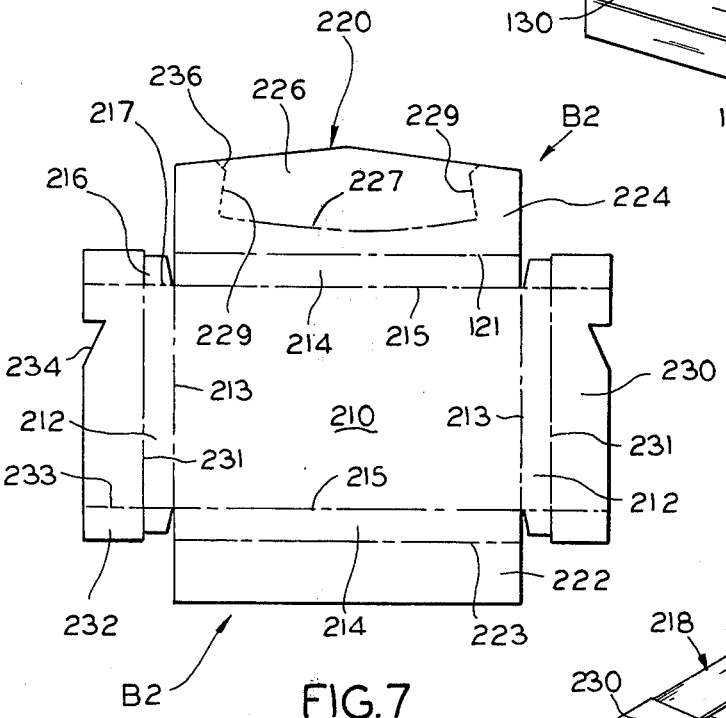
Figure 8:
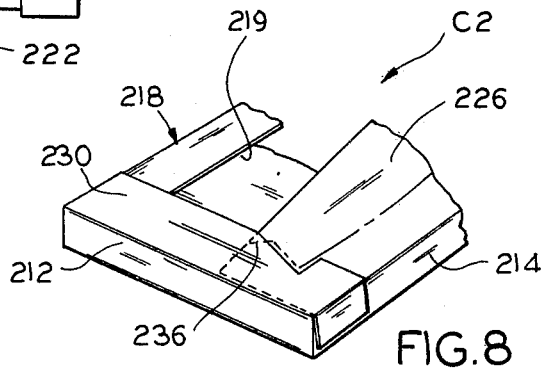

FIGS. 5 and 6 are views similar to those illustrated in FIGS. 1 and 3 but illustrating a modified form of the invention; and FIGS. 7 and 8 are views similar to those illustrated in FIGS. 1 and 3 but illustrating yet another form of the invention.

It will be understood that, for purposes of clarity, certain elements may have been intentionally omitted from certain views where they are believed to be illustrated to better advantage in other views.

THE DESCRIPTION

Figure 2:
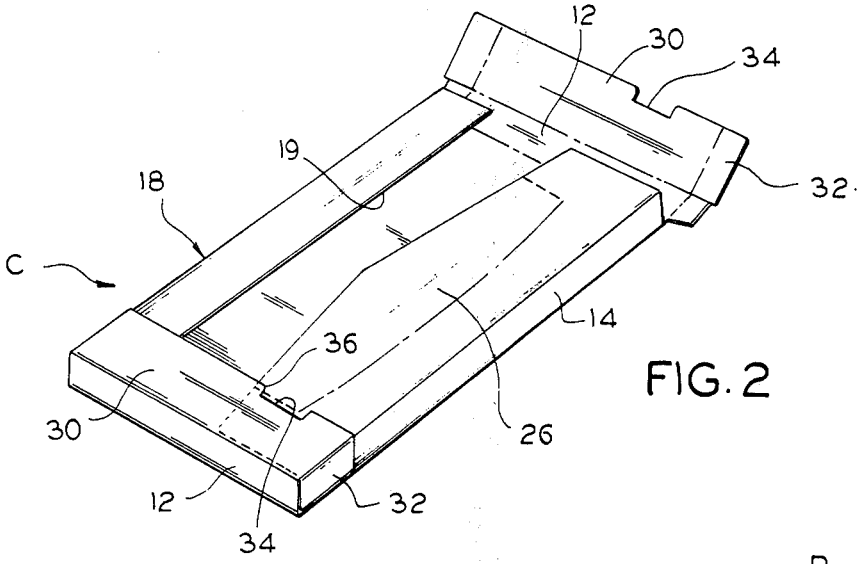
FIG. 2 is a perspective view of a carton embodying features of the invention shown in an almost completely erected condition.
Figure 4:
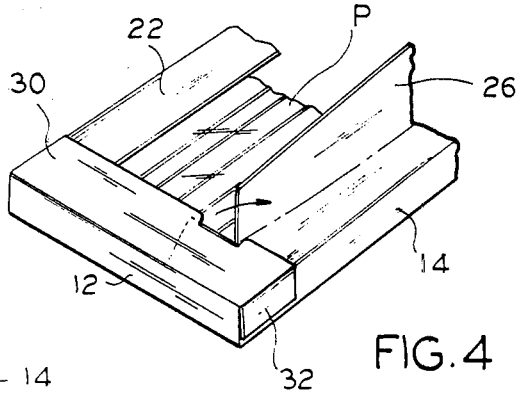
FIG. 4 is a view similar to FIG. 3 but illustrating the carton after a portion thereof has been partially detached therefrom.

Referring now to the drawings for a better understanding of the invention, it will be seen that one form of the invention is illustrated in FIGS. 1 through 4. It will be understood that the carton C illustrated in FIGS. 2 through 4 is a display carton of the type used to package a product P such as bacon, and may be formed from a unitary blank B of foldable sheet material such as paperboard as illustrated in FIG. 1.

Still referring to FIGS. 1 through 4, it will be seen that the carton includes a preferably rectangular flat bottom wall 10 having opposed pairs of side and end walls 12 and 14 foldably joined to opposite side and end edges thereof along fold lines 13 and 15, respectively, and upstanding therefrom to form a tray-like structure. A pair of inner corner connecting flaps 16 may be joined to opposite ends of each side wall 12 along fold lines 17. Inner corner flaps 16, when the carton is erected, are folded inwardly to lie inside of side portions of related end walls 14. The upper portion of the tray structure is closed by a top wall indicated generally at 18 which may be provided with a central opening 19.

It is presumed that the product contained in the carton will be enclosed in or covered by a sheet of transparent plastic film not shown.

The top wall 18 of the carton includes a pair of opposed end panels 20 and 22 foldably joined to the upper edges of end walls 14 along fold lines 21 and 23 respectively, and disposed to extend inboardly therefrom.

It will be noted that one of the top wall end panels 20 includes a generally U-shaped retaining section 24 having formed therein a partially removable view section 26 which is located intermediate the sides of retaining section 24. Viewing section 26 is joined to retaining section 24 by means of a hinge line 27 which extends the entire width of the viewing section and which is located between the free inboard edge of end panel 20 and fold line 21 which joins end panel 20 to its related end wall 14. Viewing section 26 is also partially removable joined to retaining section 24 by a pair of weakened lines 29 which extend from the ends of hinge line 27 to the free inboard edge of end panel 20.

It will be noted that hinge 27 is preferably bowed or arcuate in contour and the purpose of this specific configuration is explained later in the specification.

Top wall 18 of the carton also includes a pair of opposed side panels 30 which are foldably joined at their outboard edges along fold lines 31 to the upper edges of related side walls 12. At the opposed ends of each side wall panel 30 there are provided a pair of outer corner connecting flaps 32 which are foldably joined on fold line 33 to side panel 30. Connecting flaps 32 are adapted to be folded downwardly from side panels 30 and secured in any desired manner, such as by adhesive or heat seal, to the outer surfaces of side portions of related end walls 14. At their inboard edges, each of the side panels 30 are provided with notches 34 and corner lock portions 36, the purpose of which is described later in the specification.

Again referring to FIGS. 3 and 4, it will be seen that in order to inspect a portion of the contents of the carton, end panel viewing section 26 may be lifted by detaching its side edges from retaining section 24 along the weakened lines 29. In order to prevent the retaining section 26 from being torn beyond the weakened lines 29, hinge line 27 has been bowed or curved. This not only helps in preventing the excessive tearing of the panels of the carton but it also serves to flex the viewing section to urge it to return to the closed position.

It will also be noted that the weakened lines 29 which separate the viewing section 26 from the retaining section 24 are located outboardly of the inboard edges of side panels 30. Thus there is provided a double thickness of paperboard at the outboard extremities of weakened lines 29, and this also serves to resist excessive tearing of the carton when the viewing section is lifted and detached for viewing of the contents.

Referring now to FIGS. 5 and 6 of the drawing, it will be seen that a slightly modified form of the invention is shown. Portions of the structure corresponding to portions in the previously described embodiment have been designated by corresponding sets of numerals. The primary difference between the embodiment of FIGS. 5 and 6 and the previously described embodiment is that side panels 130 are not provided with notches which afford lock portions; however, weakened lines 129 in end panel 120 are flared outwardly at the ends thereof to provide projection 136 at opposite corners of viewing section 126. These projects 136 serve as locking tabs which are engaged under the edges of side panels 130 upon reclosure of the viewing section 126 after the inspection of the contents of the carton.

Referring now to FIGS. 7 and 8, it will be seen that a slightly modified form of the invention is provided. Again, portions of the structure corresponding to similar portions in previous embodiments have been designated with corresponding numerals. The primary difference of the structure illustrated in FIGS. 7 and 8 is that notches 234 have a slightly different contour than the notches of the first embodiment, and weakened lines 229 in end panel 220 have different configurations than the weakened lines of previous embodiments. But again, it will be noted that the ends of weakened lines 229 are flared outwardly to provide lock tab portions 236 at the outer corner of the viewing section 226, and these locking tabs may be engaged under the edges of side panels 230 to retain the viewing section in closed position.

We claim:

1. In a carton, formed of a unitary blank of foldable paperboard, for holding and displaying a product such as bacon, the combination of:

(a) a bottom wall;

(b) opposed pairs of side and end walls foldably joined to and upstanding from opposed side and end edges of said bottom wall;

(c) a top wall including:

(i) a pair of end panels spaced from each other and foldably joined to and extending inboardly from upper edges of said end walls;

(ii) a pair of side panels spaced from each other and foldably joined to and extending inboardly from upper edges of said side walls and having portions overlying and secured with respect to portions of at least one of said end panels;

(d) said one end panel including:

(i) a generally U-shaped retaining section joined along an outboard edge to a related end wall;

(ii) a viewing section located intermediate the sides of said retaining section;

(e) said viewing section being partially detachably joined to said retaining section by:

(i) a hinge line extending across the entire width of said viewing section and disposed between a free inboard edge of said one end panel and the fold line joining said one end panel to said related end wall;

(ii) a pair of spaced lines of weakness extending from opposite ends of said hinge line to said free inboard edge of said first end panel, so that said viewing section may be detached, at its side edges along said lines of weakness, from said retaining section to permit viewing of a portion of said product;

(f) said viewing section including portions having interlocking engagement with portions of said side panels to retain said viewing section in a closed position after it has once been opened.

2. A carton according to claim 1, wherein said hinge line is not straight.

3. A carton according to claim 1, wherein said hinge line is generally arcuate.

4. A carton according to claim 1, wherein said hinge line is bowed outboardly toward the fold line between said one end panel and said related end wall.

5. A carton according to claim 1, wherein portions of said weakened lines are spaced from each other a distance greater than the minimum distance between major portions of the free inboard edges of said side panels.

6. A carton according to claim 1, wherein said side panels are provided at their inboard edges with notches which are located adjacent related lines of weakness of said viewing section.

7. A carton according to claim 6, wherein said notches are generally rectangular in configuration.

8. A carton according to claim 6, wherein said notches are generally triangular in configuration.

9. A carton according to claim 6, wherein said notches provide exposure for portions of said viewing sections.

10. A carton according to claim 6, wherein said weakened lines have portions lying within and generally parallel to free inner edges of said notches.

11. A carton according to claim 1, wherein said end panels are completely free from attachment to each other and said side panels are completely free from attachment to each other.

12. A carton according to claim 1, wherein said side panels each have a locking portion projecting over a related corner of said viewing section.

13. A carton according to claim 1, wherein said viewing section has at the free corners thereof, locking portions projecting under related marginal areas of related side panels.

14. A carton according to claim 1, wherein said side panels have foldably joined to opposed ends thereof connecting flaps secured to outer surfaces of related end walls.

* * * * *